US005352179A

United States Patent [19]

De Lise

[11] Patent Number: 5,352,179

[45] Date of Patent: Oct. 4, 1994

[54] FLATTENING FOLDED MINIATURE PRINTED ITEMS

[76] Inventor: Stephen W. De Lise, c/o Mini-Graphics, 45 St. John's Pl., Freeport, N.Y. 11520

[21] Appl. No.: 114,157

[22] Filed: Sep. 1, 1993

Related U.S. Application Data

[63] Continuation-in-part of Ser. No. 850,978, Mar. 11, 1992, abandoned.

[51] Int. Cl.[5] ..... B30B 3/00

[52] U.S. Cl. ..... 493/407; 100/153

[58] Field of Search ..... 100/153, 176; 493/401, 493/409, 441, 422, 243, 244; 198/626.1, 626.2, 626.3, 626.4, 626.5; 271/7

[56] References Cited

U.S. PATENT DOCUMENTS

| | | | |
|---|---|---|---|
| 3,199,440 | 8/1965 | Banks | 100/153 |
| 3,473,244 | 10/1969 | Milone | 100/153 |
| 3,738,897 | 6/1973 | Bianchini | 100/153 |
| 3,801,250 | 4/1974 | Kaiser | 100/153 |
| 5,125,330 | 6/1992 | Reist | 100/153 |

*Primary Examiner*—Jack W. Lavinder
*Attorney, Agent, or Firm*—Collard & Roe

[57] ABSTRACT

The invention relates to flattening multiple folded miniature printed items by employing flat continuous belts encircling the large rollers and smaller input and output rollers so that the miniature printed items can be crushed and squeezed between the belts and rollers.

4 Claims, 3 Drawing Sheets

FLATTENING FOLDED MINIATURE PRINTED ITEMS

This application is a continuation-in-part of application Ser. No. 07/850,978, filed Mar. 11, 1992 now abandoned.

BACKGROUND OF THE INVENTION

The invention relates to improvements in machinery for processing folded printed items and more particularly machinery for crushing and squeezing folded miniature items such as may be found in U.S. Classes 250, and 377, subclasses 222.2,227.26 and 6, 53 respectively.

1. Technical Field

The invention relates to a mechanism for crushing folded miniature printed items such as instructional brochures packaged with pharmaceuticals and cosmetics having a tendency for springiness because of the multiple folds of the printed sheet from which they are made.

2. Description of the Prior Art

Conventional folding machines employed for folding miniature items such as brochures, instructional booklets, etc. are unable to remove the springiness of the item because the rollers used to squeeze the item are too large for passing the item from one roller to the other. Miniature items that are not squeezed flat introduce problems in counting and packaging the items.

SUMMARY OF THE INVENTION

The invention relates to a mechanical device for improving machinery that performs multiple folds on single sheets of printed information that result in miniature items such as are packaged with pharmaceuticals, cosmetics and other pre-packaged products requiring instructions or other data. The improvement comprises at least one pair of heavy, driven cylindrical rollers positioned in proximity to rollers for transporting said miniature items and instantaneously contiguous along the surfaces parallel to their longitudinal axes. Each of said rollers of each pair having a flat belt encircling it and its associated transporting rollers so that the miniature items are carried between the pair of flat belts. The chain driven heavy cylindrical rollers rotate around their longitudinal axes to drive the belts which receive the miniature items, transport them to the large, heavy cylindrical rollers where they are squeezed and crushed before being transported to the stacking conveyor machinery. The pressure between the rollers and exerted upon the belts and the miniature items can be adjusted.

It is an object of applicant's invention to provide simple, economical and reliable means to remove the springiness which results from the numerous folding of a single sheet into a miniature item.

It is a further object of applicant's invention to provide means that remove springiness resulting from the numerous folding of sheets into miniature items that is readily adaptable with presently existing folding and stacking conveyor machinery.

DETAILED DESCRIPTION

Figure 1:
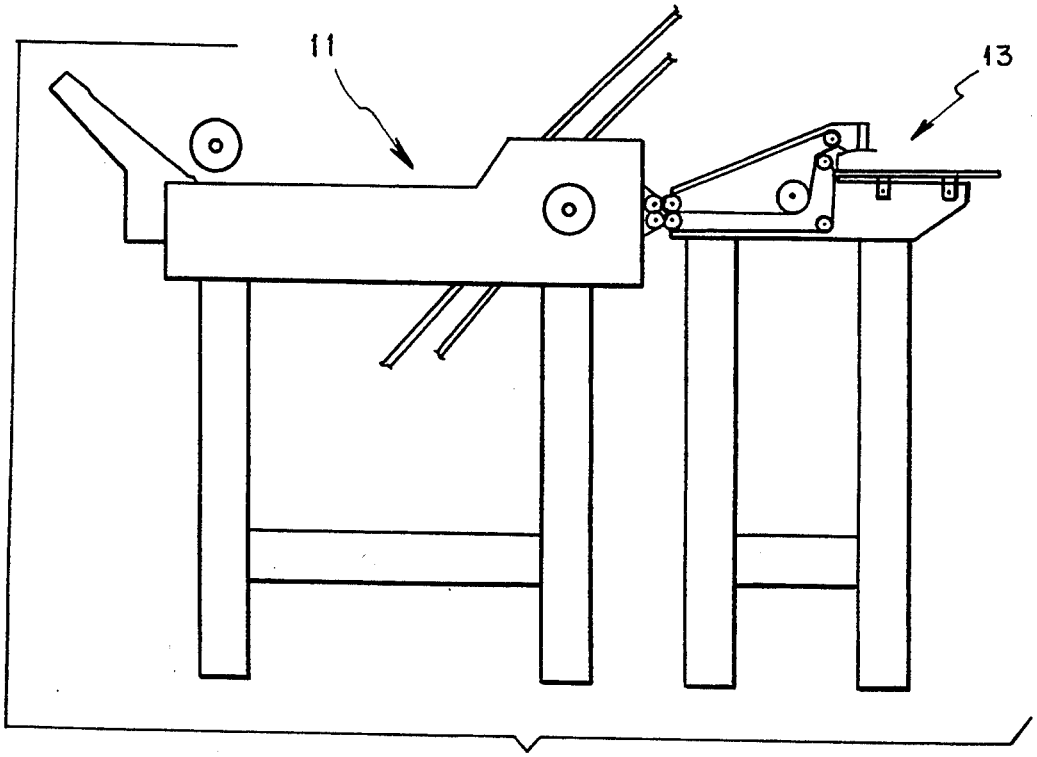
FIG. 1 shows a conventional folding machine operating with a stacking conveyor.

Folding single sheets of paper a large number of times to make miniature informational items from sheets of papers, such as booklets and brochures that are packaged with pharmaceuticals, cosmetics and other prepackaged products is well known as shown by prior art equipment shown in FIG. 1. What is not well known is how to remove the springiness resulting from the numerous folding steps which interferes with subsequent processes namely stacking, counting and packaging. Conventional weighted rollers which operate with larger printed items are unable to receive the miniature item because of the very large differences in the size of the rollers and the miniature items, and therefore the squeezing of the item is either omitted or performed while packaging the product. This is unacceptable because it is time consuming, and very costly in a competitive environment where time is money.

Figure 2:
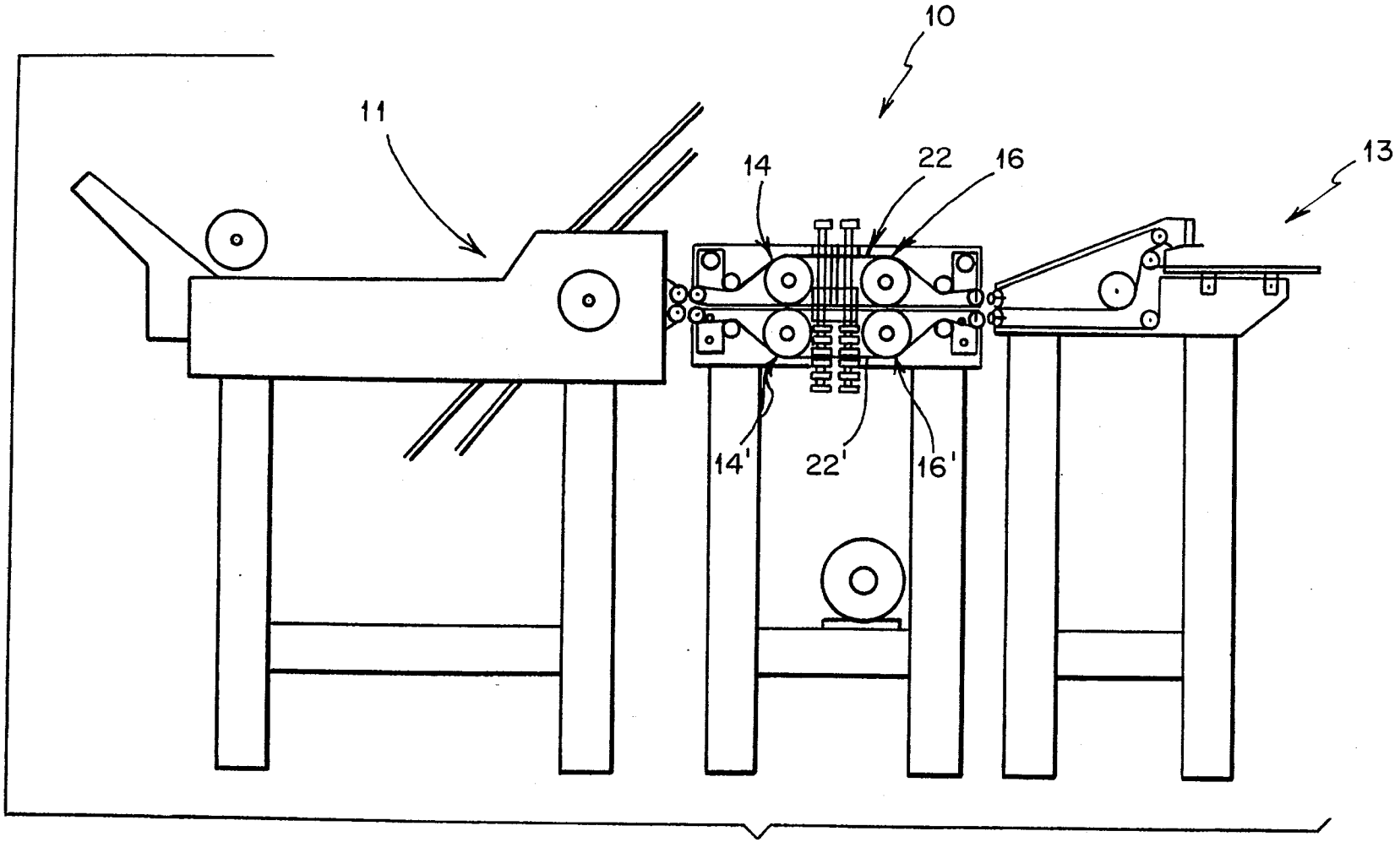
FIG. 2 shows a diagrammatic representation of applicant's invention placed in working position between a conventional folding machine and stacking conveyor.

Applicant's invention as represented in FIG. 2 addresses the problem of springiness by employing pairs of large, chain driven weighted cylindrical rollers having a pair of flat belts encircling each set of the weighted rollers and their transporting rollers and running between their mating instantaneous contiguous peripheral surfaces parallel to the longitudinal axes of the cylindrical rollers for carrying the miniature informational items between the belts for crushing and squeezing them.

Applicant's invention comprises machinery having transporting cylindrical rollers 24, 24', 26 and 26', chain driven weighted compressing rollers 14,14', 16,16', and a pair of flat belts 22, and 22' each belt 22 and 22' being driven by compressing rollers 14 and 16, and 14' and 16' respectively. Conventional equipment when employed for miniature items, is inoperable because the conventional mating rollers 14,14', 16,16' are approximately ten times the size of the smaller transportating cylindrical rollers 24, 24' 26, 26' that the rollers 14,14', 16, 16' are unable to receive the miniature items which are approximately one square inch or less from the rollers 24,24', 26, and 26'. Obviously, the miniature items would drop between the space separating the smaller rollers from the larger rollers.

Figure 4:
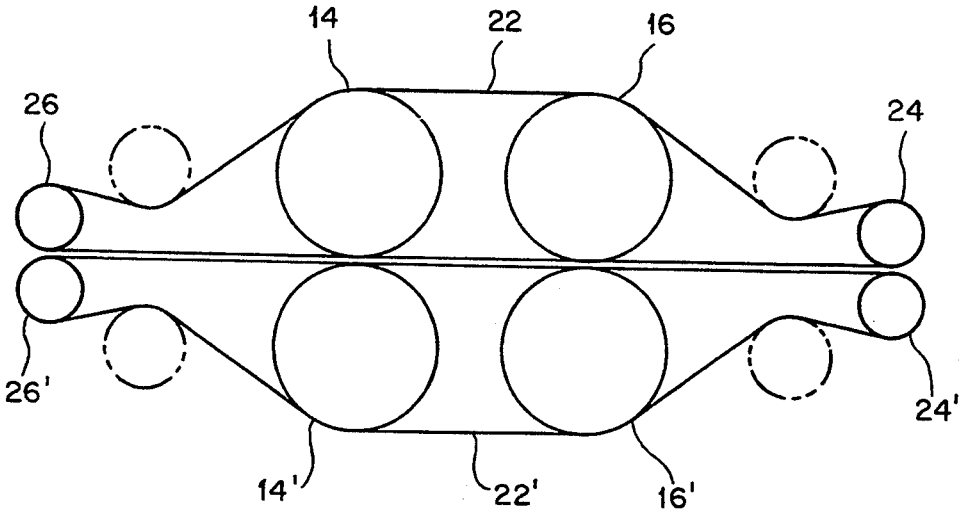
FIG. 4 shows a diagramatic representation of applicant's invention.
Figure 3:
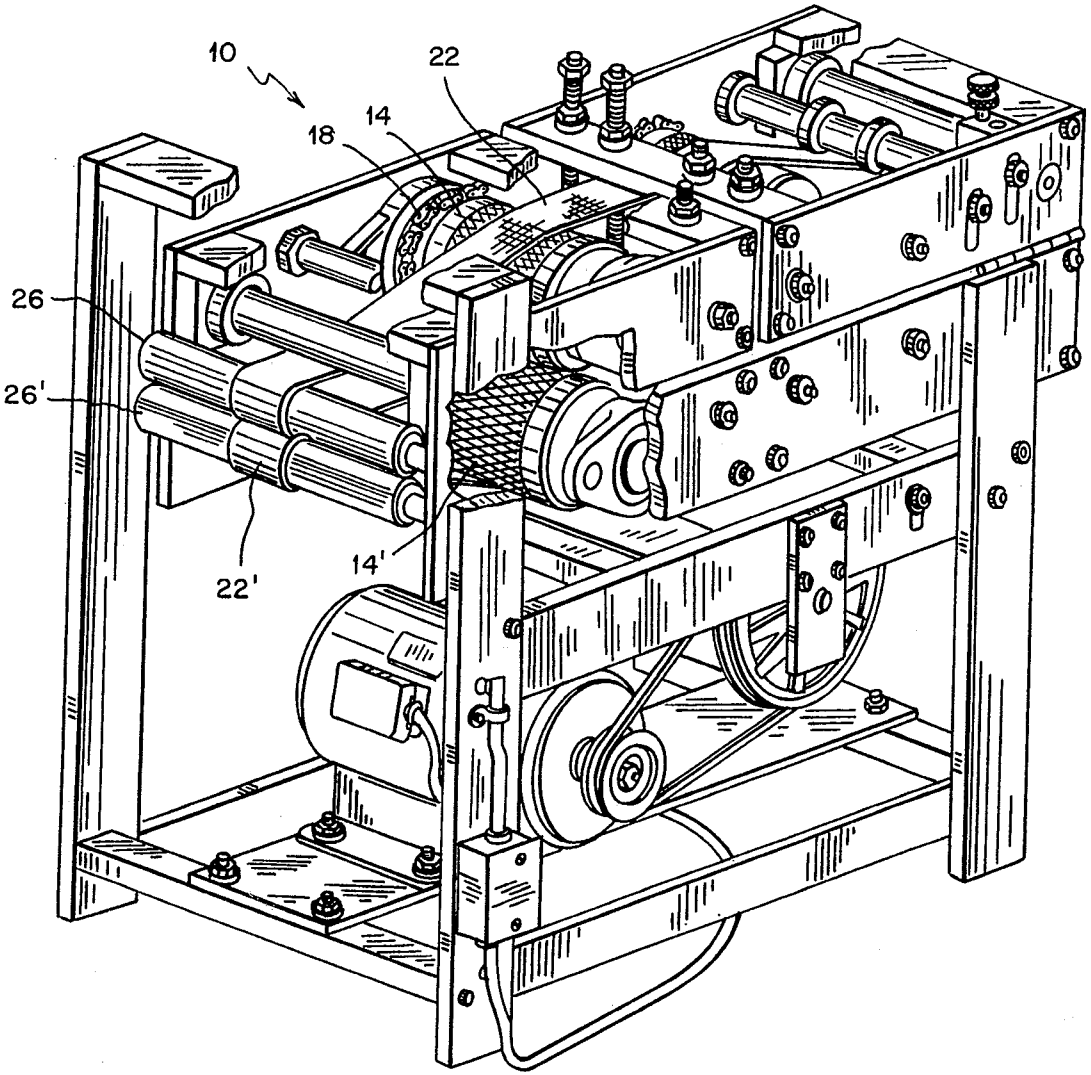
FIG. 3 shows an isometric view of Applicant's inventive machinery for removing the springiness from folded miniature informational items.

FIG. 3 shows applicant's squeezing invention which as shown in FIG. 2 is physically positioned between the folding machine 11 and stacking conveyor 13. FIG. 4 shows applicant's invention by a schematic employing belts 22,22' between mating rollers 24,24', 14,14', 16,16', 26,26' to transmit the miniature items between the rollers for crushing and squeezing of the miniature items without allowing the items to drop between the rollers. The pressure between the belts and rollers can be adjusted manually and automatically during operation by hinges and nuts as shown in FIGS. 2 and 3.

Operation of applicant's invention is simply the crushing and squeezing of the miniature items first between the belts under rollers 16,16' and then rollers 14,14' after which the items are transported to the stacking conveyor without appreciable springiness.

Although only one embodiment of applicant's invention has been shown, it is expected that the scope and breadth of applicant's invention will be limited only by the annexed claims:

I claim:

1. In combination with a compressing machine of the type wherein a folding machine individually folds printed sheets and feeds them serially to the compressing machine and a stacking conveyor receives the compressed sheets from the compressing machine and stacks the sheets; the folding machine, the compressing machine and the stacking conveyor cooperatively processing the printed sheets in a continuous in-line process, the compressing machine comprising:

a lower machine frame;

an upper machine frame with two sections, each section having one end pivotally mounted to said lower machine frame and a spaced opposite second free end;

each frame rotatably supporting an input roller, a pair of motor driven weighted rollers, an output roller and an endless belt encircling said rollers;

each section of the upper machine frame having one of the weighted rollers adjacent its second free end; and means for independently adjusting the distance between said second free ends and said lower machine frame to adjust the pressure between the pairs of weighted rollers;

wherein said input rollers are vertically aligned with each other and positioned adjacent an output of the folding machine for serially grasping individual folded, printed sheets fed from the folding machine;

wherein said output rollers are vertically aligned with each other and positioned adjacent an input of the stacking conveyor for serially feeding the individual compressed, printed sheets into the stacking conveyor.

2. The device according to claim 1, additionally including a chain drive for rotating said pairs of weighted rollers.

3. The device according to claim 2, wherein each roller includes a longitudinal axis around which the roller rotates, the axes all being generally parallel to each other.

4. In combination with a compressing machine of the type wherein a folding machine individually folds printed sheets and feeds them serially to the compressing machine and a stacking conveyor receives the compressed sheets from the compressing machine and stacks the sheets; the folding machine, the compressing machine and the stacking conveyor cooperatively processing the printed sheets in a continuous in-line process, the compressing machine comprising:

a lower machine frame;

an upper machine frame with two sections, each section having one end pivotally mounted to said lower machine frame and a spaced opposite second free end;

each frame rotatably supporting an input roller, a pair of motor driven weighted rollers, an output roller and an endless belt encircling said rollers;

each section of the upper machine frame having one of the weighted rollers adjacent its second free end; and means for independently adjusting the distance between said second free ends and said lower machine frame to adjust the pressure between the pairs of weighted rollers.

* * * * *